United States Patent [19]

Buck et al.

[11] Patent Number: 4,693,407

[45] Date of Patent: Sep. 15, 1987

[54] POWER IMPACT DEVICE, PARTICULARLY FOR FASTENERS

[75] Inventors: Manfred Buck, Nürtingen; Siegfried Fehrle, Leinfelden-Echterdingen; Martin Hölzel, Stuttgart; Wilfried Kabatnik, Leinfelden; Wolfgang Schmid, Filderstadt; Karl Wanner, Leinfelden-Echterdingen, all of Fed. Rep. of Germany

[73] Assignee: Robert Bosch GmbH, Stuttgart, Fed. Rep. of Germany

[21] Appl. No.: 880,915

[22] Filed: Jul. 1, 1986

[30] Foreign Application Priority Data

Sep. 23, 1985 [DE] Fed. Rep. of Germany ..... 3533840

[51] Int. Cl.[4] ..... B25C 5/06; B25C 5/15

[52] U.S. Cl. ..... 227/109; 227/120; 227/131

[58] Field of Search ..... 227/8, 78, 109, 120, 227/131, 130, 132, 139, 156

[56] References Cited

U.S. PATENT DOCUMENTS

| | | | |
|---|---|---|---|
| 2,332,257 | 10/1943 | Polzer | 227/104 |
| 4,571,805 | 2/1986 | Niedecker | 227/109 X |
| 4,598,852 | 7/1986 | Olesen | 227/109 X |

FOREIGN PATENT DOCUMENTS

| | | | |
|---|---|---|---|
| 3126536 | 1/1983 | Fed. Rep. of Germany | 227/109 |
| 745458 | 2/1956 | United Kingdom | 227/109 |

*Primary Examiner*—Paul Bell

*Attorney, Agent, or Firm*—Michael J. Striker

[57] ABSTRACT

A power impact device, particularly for fasteners, comprises a propelling passage, a driver movable in the propelling passage, a magazine for fasteners and crossing the propelling passage, and an abutment arranged for positioning a set of fasteners for separating a frontmost fastener by the driver, the abutment being formed so that only a part of the cross-section of the set of fasteners is supported and so that it is displaceable relative to the propelling passage, the driver having a cross-section which deviates from a cross-section of the propelling passage over a fit tolerance so as to allow narrowing of the propelling passage without preventing movement of the driver and reducing its thickness.

20 Claims, 17 Drawing Figures

41
42
47
46
28
50
49
48
44
45
40
38
9
12
10
32
30
33
31
33
35
34
11
39

42
47
43
43

POWER IMPACT DEVICE, PARTICULARLY FOR FASTENERS

BACKGROUND OF THE INVENTION

The present invention relates to a power impact device, particularly for fasteners.

More particularly it relates to a power impact device for fasteners which has a driver movable in a prolelling passage, a magazine which accommodates fasteners and crosses the prolelling passage, and an abutment which positions the set of fasteners for separating a frontmost fastener by the driver. Devices of the above mentioned general type, in particular for driving staples and generally known as staplers, are known in the art and disclosed, for example, in the German patent document DE-GM No. 8,303,460. It is known to provide such devices with exchange front blades so that staples of different back thickness can be used. Wire staples with small backs are advantageous, since the staples must not be visible. Also, several shots per magazine filling can be performed. Wire staples with wide backs are advantageous when it is necessary to fix easily breakable materials, when it is necessary to provide also a greater pulling force, for example in soft backing. The exchange of the front plates and magazine and the preparation of this differently designed parts is expensive. Moreover, this device possesses the danger that the front plates and magazine parts are exchanged and exchange parts are lost. This leads to operational disturbances. Finally, tools are required for exchanging the front plates and magazine or magazine parts.

SUMMARY OF THE INVENTION

Accordingly, it is an object of the present invention to provide an impact device which can operate in different situations with fasteners of different types and so that selectively one or at least two fasteners can be driven.

In keeping with these objects and with others which will become apparent hereinafter, one feature of the present invention resides, briefly stated, in a power impact device in which an abutment supports a part of the cross-section of a set of fasteners and is displaceable relative to a propelling passage, and a driver has a cross-section which deviates from the cross-section of the propelling passage over fit tolerance so as to allow narrowing of the propelling passage in the region of abutment without affecting the movability of the driver and reducing its thickness.

Because of the displaceability of the abutment for the set of fasteners, the shape of the abutment, and the cross-section of the driver which deviates from the cross-section of the propelling passage over fit tolerance, the propelling passage by the abutment can be narrowed from a width for two wire staples to a width for one wire staple, without affecting the movability of the driver in the propelling passage.

It is especially advantageous when the driver is formed with two tongues which make possible to deliver a second impact against a wire staple which during the first impact has not been completely driven into a workpiece. The set of staples can be displaced back by means of the abutment so that no wire staple is located near the propelling passage. Thereby the movability of the driver is not affected.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
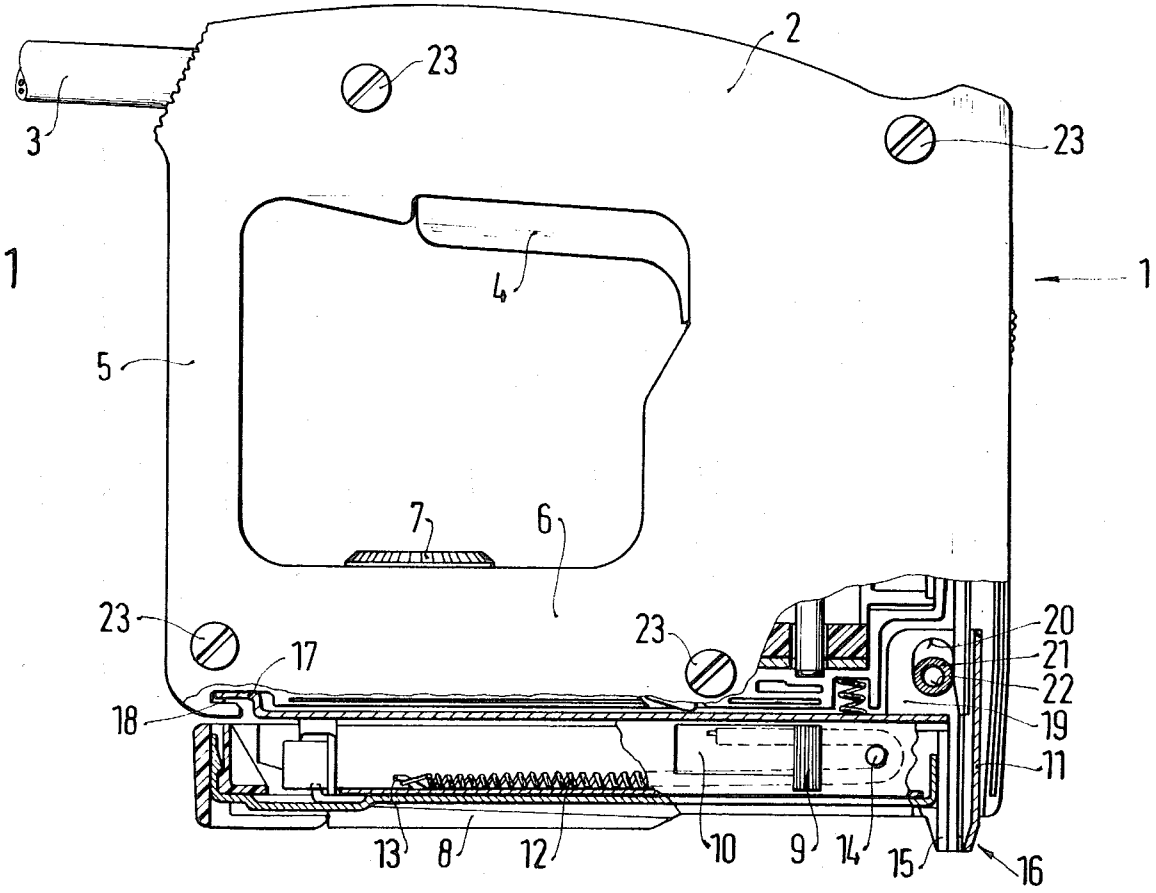
FIG. 1 is a side view of a stapler in accordance with the present invention, partially in section.

A stapler 1 shown in FIG. 1 has a longitudinally subdivided housing with two shells. This housing forms a hand grip 2 with an inlet opening for an electrical supply conduit 3 and an actuating handle 4. The hand grip arranged on the upper side of the stapler 1 is connected by via a web 5 with a lower part 6 of a stapler. The lower part 6 accommodates electrical or electronic switching elements which are required for releasing the stapler impact and for adjusting its force. The conduit 3 leads through the web 5 to the switching elements.

An adjuster 7 serves, in the embodiments of FIGS. 1–10 and 14, for adjusting the impact force of the driver for the wire stitches. A magazine 8 is mounted on the lower part 6 of the stapler and can accommodate a set of fasteners 9. The set of fasteners 9 is urged by a slider 10 to abutment against a front plate 11. It is driven by a magazine spring 12. A hook 13 supports the magazine spring 12. The magazine spring 12 is formed as a pulling spring and deflects in its working direction over a pin 14. In this manner the required spring length is obtained for a long spring path corresponding to the magazine path, by means of which a substantially constant pressure must be applied upon the set of fasteners. The magazine 8 finally forms with a part 15 a mouth piece 16. By means of a curved edge 17, the magazine 8 is articulately inserted into a pocket 18 of the housing of the stapler 1. The magazine 8 is provided with a tongue 19 at the side of its mouth. The tongue 19 has an elongated opening 20, by means of which the magazine 8 is suspended on a hub 21 of the housing. The latter has a threaded opening 22. One of the screws can be screwed into the threaded opening 22 for assembling the shells of the housing with one another. The screws are identified with reference numeral 23 and shown at four points of the housing.

Figure 2:
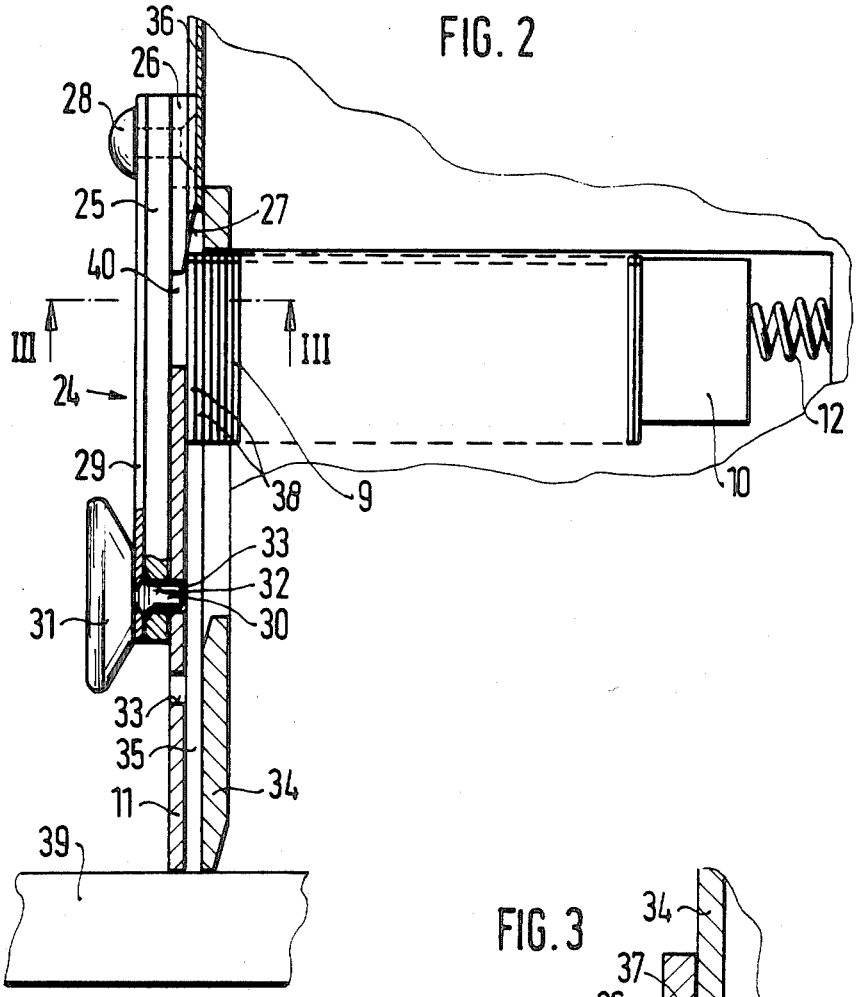
FIG. 2 is a partial view of the inventive stapler in accordance with the first embodiment of the invention, partially in section.
Figure 3:
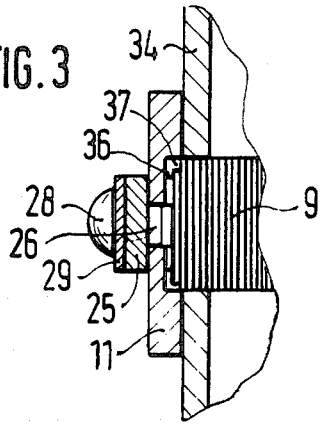
FIG. 3 is a view showing a section taken along the line III—III in FIG. 2.

In the embodiment shown in FIGS. 2 and 3, an adjusting device 24 is arranged forwardly of the front plate 11. The adjusting device includes a slider 25 with an abutment body 26 having a running incline 27. The abutment body 26 is fixedly connected with the slider 25 by a rivet 28. A spring band 29 is mounted on the slider 25 by the rivet 28. The free end of the spring band 29 carries an arresting pin 30 with a handle 31. The arresting pin 30 extends through an opening 32 in the slider 25 and can engage in one of two arresting openings 33 in the front plate 11 of the stapler 1. By means of this arresting device the slider 25 can be fixed in different positions. In the upper position of the slider 25 shown in FIG. 2, the running incline 27 provides a first abutment for the set of fasteners 9. The front plate 11 and the rear plate 34 together form a propelling channel 35. A driver 36 is guided in a propelling passage 35 and has a U-shaped cross-section. The abutment body 26 engages between a leg 37 of the U-shaped driver 36. In the operational position shown in FIG. 2, two fasteners 38 of the fastener set 9 are located in the propelling passage. The driver 36 can separate both fasteners 38 from the set and drive them through the propelling passage 35 into a workpiece 39. The front fastener 38 is engaged by the leg 37 in the region of its leg, while the second fastener 38 is engaged over its entire width by the end surface of the driver. Thereby the accurate separation of the fasteners 38 and the driving of both fasteners into the workpiece 39 is reliably guaranteed.

When the arresting pin 30 is withdrawn by the handle 31 from the upper arresting opening 33, the slider 25 can be pulled downwardly with all parts mounted thereon, by the handle 31. When the arresting pin 30 engages into the lower arresting opening 33 the slider 25 is fixed in the second working position. On the way there, the abutment body 26 also slides downwardly in a guiding slot 40 of the front plate 11. Its running incline 27 presses the fastener set 9 by the thickness of one fastener 38 from the propelling passage 35. The downwardly striking driver 36 can now separate only one fastener from the fastener set 9 and drive the same into the workpiece 39.

In the above described embodiment, with the simple displacement of the abutment body 26 in cooperation with respectively shaped driver 36, switching of the operation from driving of one fastener to driving of two fasteners is simultaneously made possible.

Figures 4, 5:
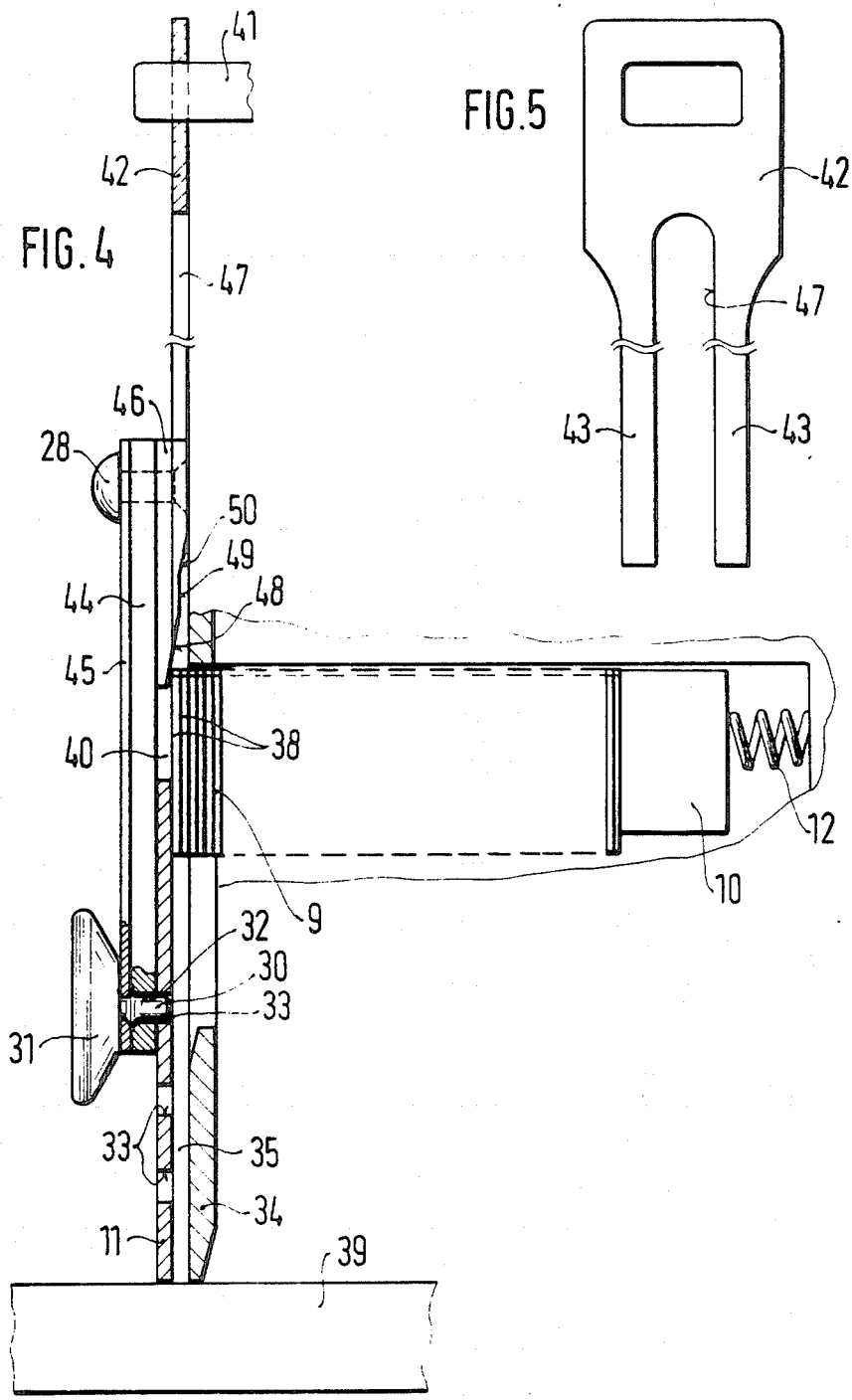
FIG. 4 is a partial view substantially corresponding to the view of FIG. 2, in accordance with a further embodiment of the invention, in section.
FIG. 5 is a front view of a driver of the stapler in accordance with the embodiment of FIG. 4.

In the embodiment shown in FIGS. 4 and 5, in contrast to the embodiment of FIGS. 2 and 3, only the number of the arresting opening 33 and the length of the slider and the spring band are changed, and the abutment body and the driver are somewhat modified. FIG. 4 shows an additional driving member 41 for a driver 42. The driver 42 does not have a U-shaped cross-section, but instead it is formed as a fork with two fork legs 43. A slider 44 carries a spring band 45 and the arresting pin 30 with its handle 31. The arresting pin 30 extends through an opening 32 of the slider 44. There are here three arresting openings 33 instead of two openings. An abutment body 46 is connected with the slider 44 by the rivet 28. In addition to the guiding slot 40 in the front plate 11, the abutment body 46 engages also in a slot 47 between the legs of the fork 43. A first running incline 48 on the abutment body 46 merges into a not raising abutment surface 49 and then into a second running incline 50. FIG. 4 shows two fasteners 38 of the fastener set 9 located in the propelling passage 35. The running surface 49 lies in one plane with a separating plane between both fasteners 38 in the propelling passage 35.

When the downwardly displacing driver 42 strikes with its fork legs 43 against both fasteners 38, they are separated from the fastener set 9 and are driven into the workpiece 39.

For switching the operation from the two-fastener to one-fastener, the slider 44 is pulled downwardly similarly to the slider 25 in the embodiment of FIGS. 2 and 3, and engage into the next arresting opening 33. The abutment surface 49 comes to abutment against the fastener set 9. The latter is displaced by the thickness of one fastener 38 from the propelling passage 35. Therefore, only one fastener 38 can be driven.

When the slider 44 after arresting the arresting pin 30 is pulled further downwardly and engages in the lowest arresting opening 33, the fastener set 9 is completely displaced from the propelling passage 35. The driver 42 can now strike downwardly at both sides of the abutment body 46 with its fork legs 43. A fastener which has not been completely driven during the first srtike, here one or two fasteners 38, can now be completely driven into the workpiece 39. The function of the stapler 1 in the embodiment of FIGS. 2 and 3 is therefore expanded by an important additional function.

Figure 6:
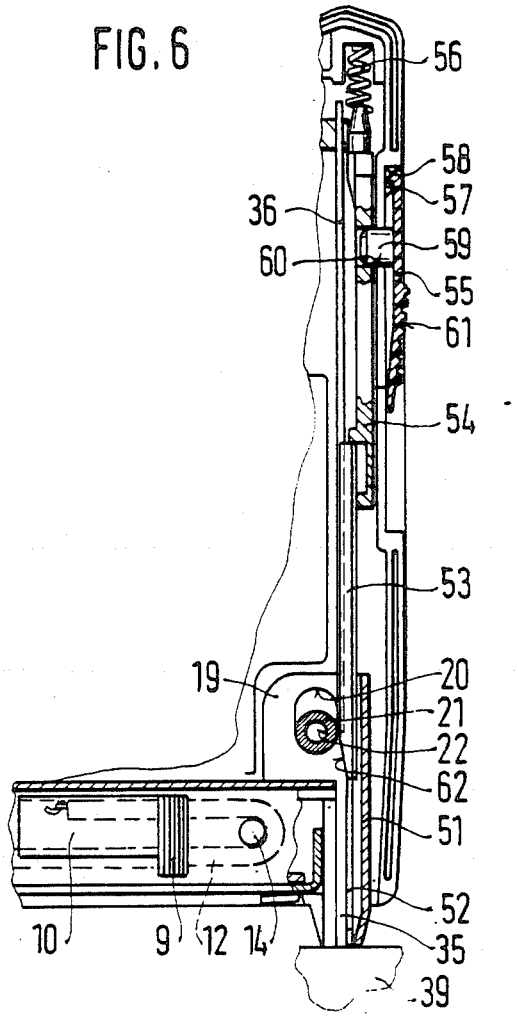
FIG. 6 is a partial view, substantially corresponding to FIG. 2, of a third embodiment of the invention, in section.

In the embodiment of FIG. 6, as already shown in FIG. 1, the front plate is fixedly connected with the magazine 8. It is identified with reference numeral 51. A guiding plate 52 cooperating with the magazine 8 performs the guidance of the displaceable abutment. The displaceable abutment is here formed by a slider 53. The slider 53 is connected via a coupling slider 54 with an actuator slider 55. The coupling slider 54 is arranged under the action of the spring 56. The spring 56 urges it to move always toward the mouth piece 16. In the upper position of the actuating slider 55, the spring 56 is pre-tensioned. A hub 57 inside the guidance for the actuating slider 55 is associated with a respective projection 58 at the upper end of the actuating slider 55 and serves for fixing the actuation slider 55 in the upper position against the force of the spring 56. The actuating slider 55 is connected via a pin 59 with the coupling slider 54. A bearing opening 60 which serves for this connection allows a tilting of the actuator slider 55, which makes possible engagement of the projection 58 behind the hub 57 or arresting of this arresting connection. A gripping edge 61 facilitates handling of the actuating slider 55. An inclined running surface 62 at the lower end of the slider 53 has the same function as the running incline 27 in the embodiment of FIGS. 2 and 3.

In the shown upper position of the sliders 53–55 the stapler is ready for striking two fasteners 38 simultaneously. The driver 36 acts with its full U-shaped end surface. When now only one fastener 38 must be driven, the user presses the gripping edge of the actuating slider 55. It tilts with its pin 59 into the bearing opening 60, so that the projection 58 disengages from the hub 57. Under the action of the spring 56 the sliders 53–55 are driven downwardly, until the actuating slider 55 reaches its lower end position. Thereby the running surface 62 displaces the fastener set 9 so far from the propelling passage 65 that only one fastener 38 extends into the locking channel 38. For a new switching to two-fastener operation, the actuating slider 55 must be engaged at the gripping edge 61 and returned against the action of the spring 56 to its initial position.

Figure 7:
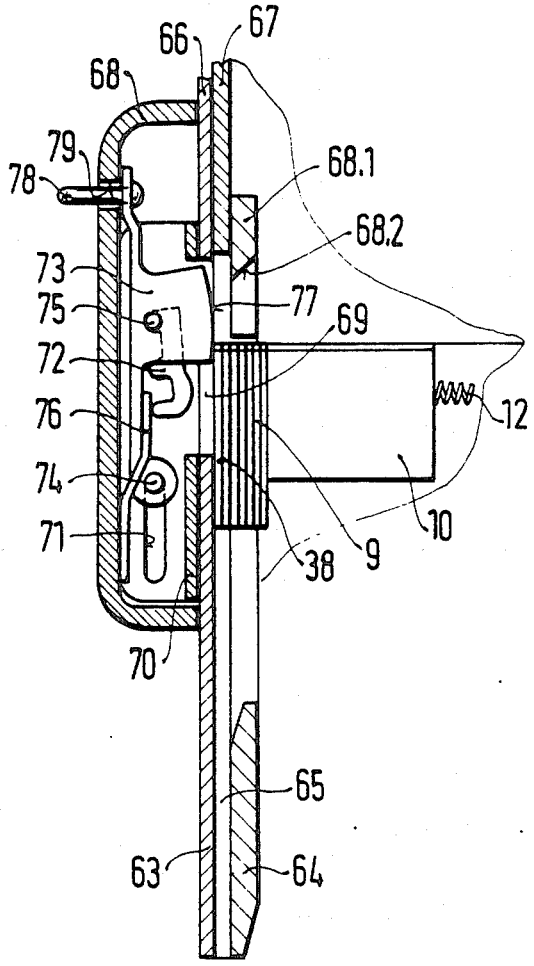
FIG. 7 is a partial view similar to FIG. 2, of a fourth embodiment of the invention, in section.

In the embodiment shown in FIG. 7, the fastener set 9 abuts against a front plate 63 under the action of the slider 10 and the magazine spring 12 which drives the latter. The front plate 63 forms together with a rear plate 64 a propelling passage 65. A driver composed of two sheets 66 and 67 is guided in the propelling passage 65. The thickness of one driving sheet corresponds to the thickness of one fastener 38, and two fasteners are located one behind the other in the propelling passage 65. A cap 68 overlaps a slot 69 in the front plate 63. A U-shaped angular piece 70 is mounted inside the cap 68 on the front plate 63 around the slot 69. Differently shaped guiding slots are stamped in the U-legs of the angular piece 70. The slots include a straight slot 71 and a coulisse-shaped slot 72. An actuating slider 73 is supported in the slots. First, it is guided with a pin 74 in the straight slot 71. A guiding pin 75 connected with the actuating slider 73 engages in the coulisse-shaped slot 72. The coulisse-shaped slot 72 has three arresting points in which the guiding pin 75 can be arrested. A flat spring 76 serves for retaining the guiding pin 75 in a selected arresting position, and the fastener set 9 cannot be inserted, with its front fastener 38 pressing against an abutment surface 77 of the actuating slider 73. A pin 78 extends outwardly through an opening 79 in the cap 68 and serves as an actuating member.

When the actuating slider 73 is pressed inwardly with the pin 78 against the force of the flat spring 76, one of the arresting positions of the guiding pin 75 in one of the arresting formations in the coulisse-shaped slot 72 can be found, in which the actuating slider 73 with the cap 67 can be displaced and thereafter the pin 78 can be released. When the sheet 76 of the driver is formed fork-shaped as shown in the embodiment of FIGS. 4 and 5, and the sheet 67 is formed as an enclosed sheet, a U-shaped driver corresponding to the embodiment of FIGS. 2 and 3 is produced. With such a driver 66–67 the arresting positions provided by the coulisse-shaped slot 72 are used as follows: In the upper arresting position, the running surface 77 allows in the propelling passage 55 two fasteners which can be driven simultaneously. The central arresting position fixes such position of the running surface 77 in which only one fastener can be located in the propelling passage 65. During movement of the cap 68 and the actuating slider 73 to the lower arresting point in the coulisse 72, the fastener set 9 as a whole is displaced from the propelling passage 65. A catch 68.1 connected with the cap 68 engages in front of the front fastener of the fastener set 9 into its guide. When the guiding pin 75 is slid to the lower arresting depression, the running surface 77 retreats from the locking passage 65. The fastener set abuts under the action of the magazine spring 12 against an inclined catching surface 68.2 of the catcher 68.1 and thus remains outside the propelling passage 65. A subsequent strike is therefore possible. If also the sheet 67 of the driver 66/67 is made fork-shaped, the third arresting possibility in the coulisse-shaped slot 72 can be selected so that the additional function of the subsequent strike is provided as described in the FIGS. 4 and 6, also without the catch 68.1.

Figure 8A:
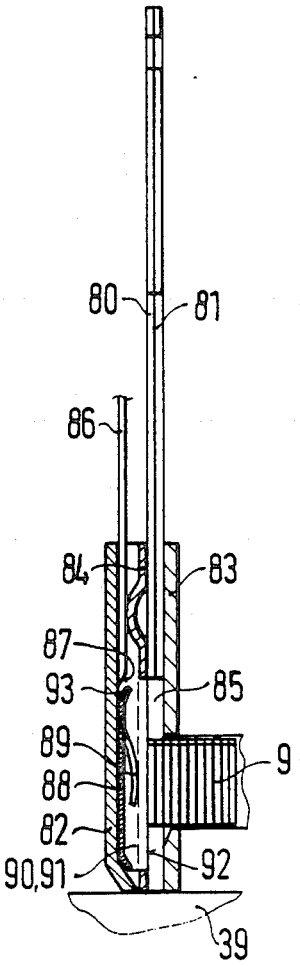
FIGS. 8A and 8B show a fifth embodiment of the invention in a sectioned partial view and in a side view, with an adjustment for 2-staple operation.
Figure 8B:
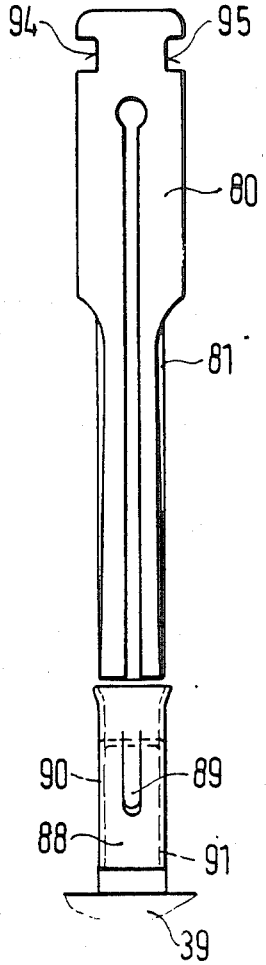

The embodiment shown in FIGS. 8A and 8B, illustrates a further possible modification with a two sheet driver 80/81. A guiding plate 84 is clamped between a front plate 82 and a rear plate 83. A propelling passage 85 is formed between the guiding plate 84 and the rear plate 83. An adjusting slider 86 is guided between the front plate 82 and the guiding plate 84 has a thickness corresponding to one fastener 38. Its lower end surface 87 is inclined. A U-shaped abutment 88 is arranged under the arresting slider 66 and abuts against the inner surface of the front plate 82. The U-legs of this abutment 88 engage through respective slots in the guiding plate 84. They provide the fastener set 9 with an abutment in the region of the legs of the fasteners 38. A spring tongue 89 which is cut from the abutment 88 is supported on the guiding plate and always displaces the abutment 88 against the inner surface of the front 82. The U-legs 90 and 91 with their end surfaces 99 provided as abutment are flush with the upper surface of the guiding plate 84 which is used with the rear plate 83. The upper ends of the U-legs 90, 91 are expanded in a funnel shaped manner to a width which is greater than the width of the fastener. The upper end 93 of the rear wall of the abutment 88 is somewhat turned in, so that the adjusting slider 86 together with its inclined end surface 87 can slide behind the abutment 88.

Figure 9A:
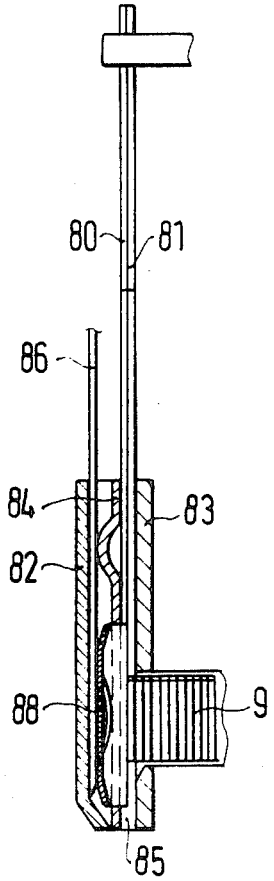
FIGS. 9A and 9B correspond to FIGS. 8A and 8B and show the adjustment for 1-staple operation.
Figure 9B:
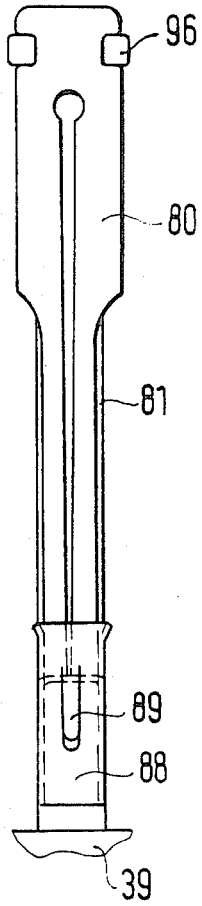
Figure 10A:
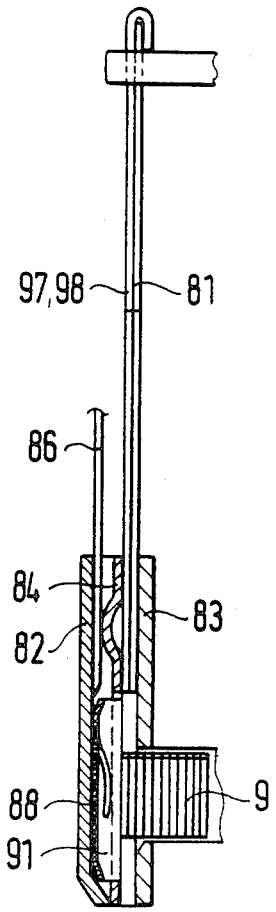
FIGS. 10A and 10B correspond to FIGS. 8A and 8B, but show a different embodiment of the driver.
Figure 10B:
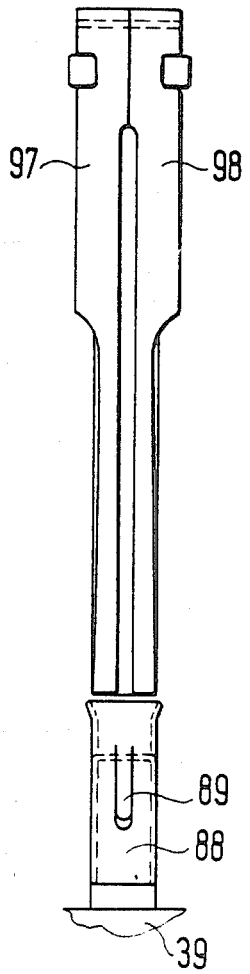

FIG. 8A shows the preparation for two-fastener operation. The sheet 80 is formed as a fork with two legs which are springy in the plane of the sheet. The sheet 81 is solid and has a rectangular cross-section. During two-fastener operation the driver 80/81 is pushed through the propelling passage 85 and thereby drives two fasteners 38 into the workpiece 39. For switching to one-fastener operation, the adjusting slider 86 is moved downwardly in the manner described in connection with FIG. 6. It is displaced between the inner wall of the front plate 84 and the rear of the abutment 88. The U-legs 90 and 91 of the abutment 88 are displaced through the slot in the guiding plate 84 and displace the fastener set 9 by the thickness of the fastener 38 from the propelling passage 85. When one-fastener operation must be performed, the legs of the sheet 80 act on the U-legs 90 and 91 of the abutment 99 which extend in funnel-shaped manner. They are forced to be compressed in a springy manner and during driving of the fastener 38 by the sheet 81 they can pass unobjectionably the prolelling passage through the U-legs 90 and 91 of the abutment 88. FIGS. 9A and 9B show this adjustment of one-fastener operation, with springing-in legs of the sheet 80 which can be introduced into the guide of the abutment 88 between the U-legs 90 and 91. Recesses 94 and 95 at the upper end of the sheets 80 and 81 in FIG. 8B and a fastener 96 of FIG. 9B show how the sheets 80 and 81 can be retained together. The embodiment of FIGS. 10A and 10B differs from the embodiment of FIGS. 8 and 9 only in that the sheet 80 is formed as a two-part sheet 97/98.

Figure 11:
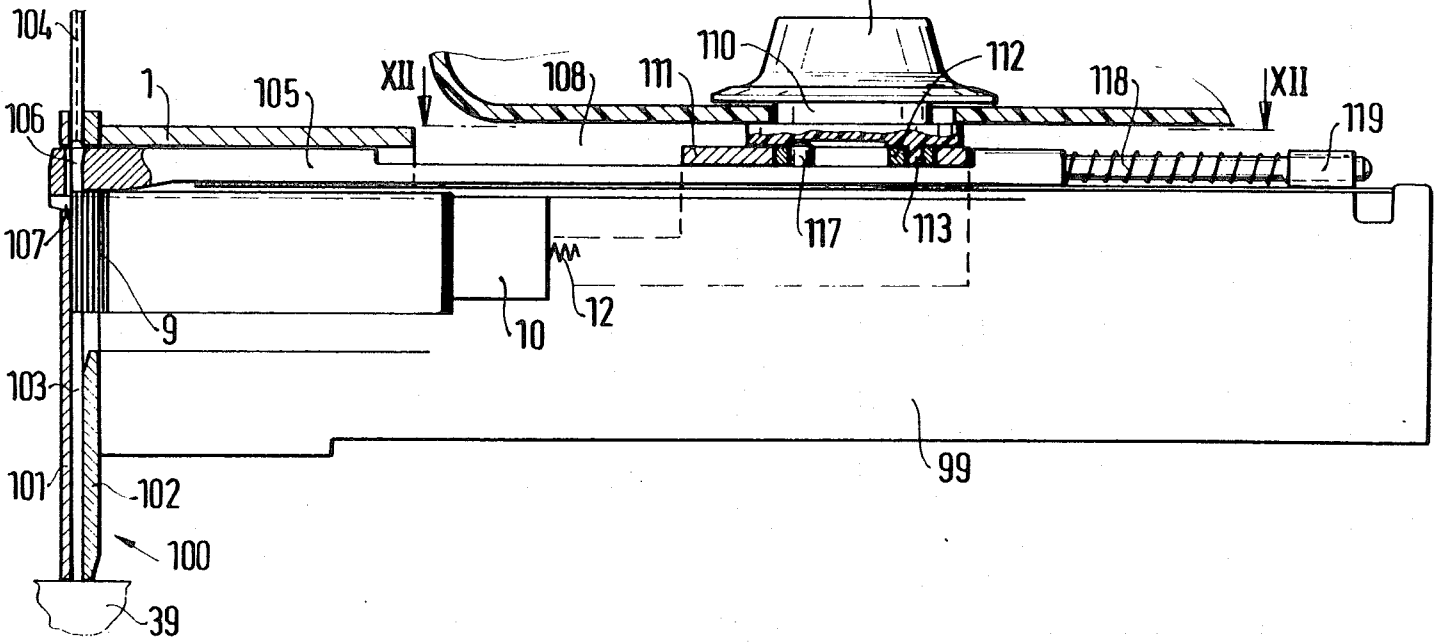
FIG. 11 illustrate a sixth embodiment of the invention, in a simplified and sectioned showing.
Figure 12:
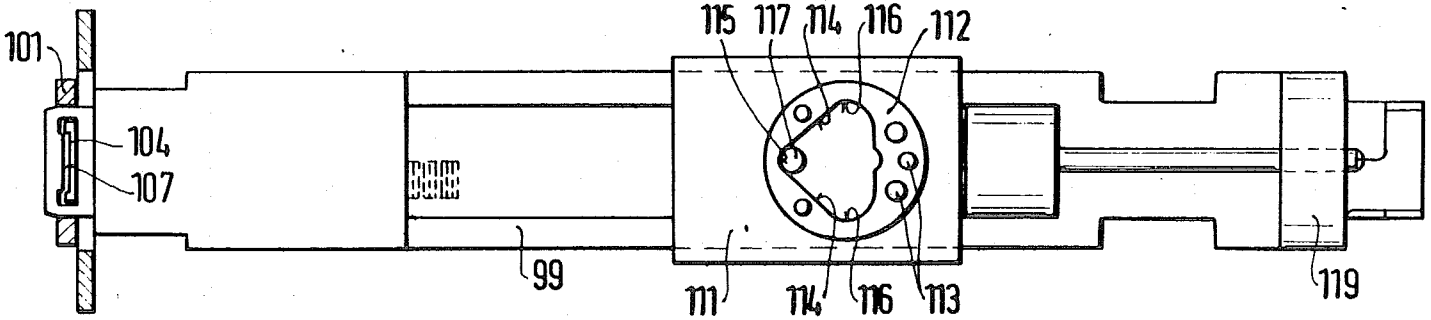
FIG. 12 is a simplified plan view of FIG. 11.

FIGS. 11 and 12 show a further embodiment of the invention in which the displacement of the abutment is performed with a slider which can be adjusted parallel to the displacement movement of the fastener set 9. A magazine 99 is mounted on the housing of the stapler. The magazine 99 accommodates the fastener set 9 in a known manner, its slider 10, and the magazine spring 12. It forms a mouth piece 100 with a front plate 101 and a rear plate 102. Both plates form a propelling passage 103. A U-shaped driver 104 is arranged so that it passes through the propelling passage 103 for striking two fasteners 38. A slider 105 is arranged between the magazine 99 and the housing of the stapler 1. The slider 105 has a recess 106 associated with a driver 104. The recess 106 has a U-shaped cross-section corresponding to the cross-section of the driver 104. This recess forms an abutment surface 107. The abutment surface 107 extends from the slider 105 downwardly into the guiding passage for the fastener set 9. A handle 109 supported in a web 108 serves for displacement of the slider 105. The support of this handle 109 is performed with the aid of an annular groove 110 in the handle, in which both shells of the housing engage with their wall. A bearing bracket 111 is fixedly connected with the magazine 99. A collar 112 of the handle 109 engages in the bearing bracket 11. The collar 112 can also be formed as a switching curve disc which is fixedly connected with the handle 109. In the shown example it is so selected, and the switching curve disc 112 is connected by pins 113 with the handle 109. A switching curve 114 is formed as an inner curve in the switching curve 112. It provides two arresting positions by arresting troughs 115 and 116 from switching from two-fastener operation to one-fastener operation and vice versa.

The switching curve 114 is sensed by means of a pin 117 which is fixedly connected with the slider 105. The spring 118, with an abutment 119 on the magazine 99, presses the slider 105 constantly with its pin 117 against the switching curve 114. FIGS. 11 and 12 show preparation for two-fastener operation. For switching to one-fastener operation, the handle 109 is rotated until the pin 117 lies in one of the arresting troughs 116. Thereby the slider 105 is withdrawn by one fastener thickness and one fastener 38 is displaced from the propelling passage 103. A subsequent striking without fastener displacement is also possible. The handle 109 is rotated further until the pin 117 engages into an arresting trough 120 of the switching curve 114. The slider 105 is withdrawn so far that it and the fastener set 9 in front of it are fully withdrawn from the path of the driver. The device is now ready for such number of subsequent strikes which is considered as desirable by the user.

Figure 13:
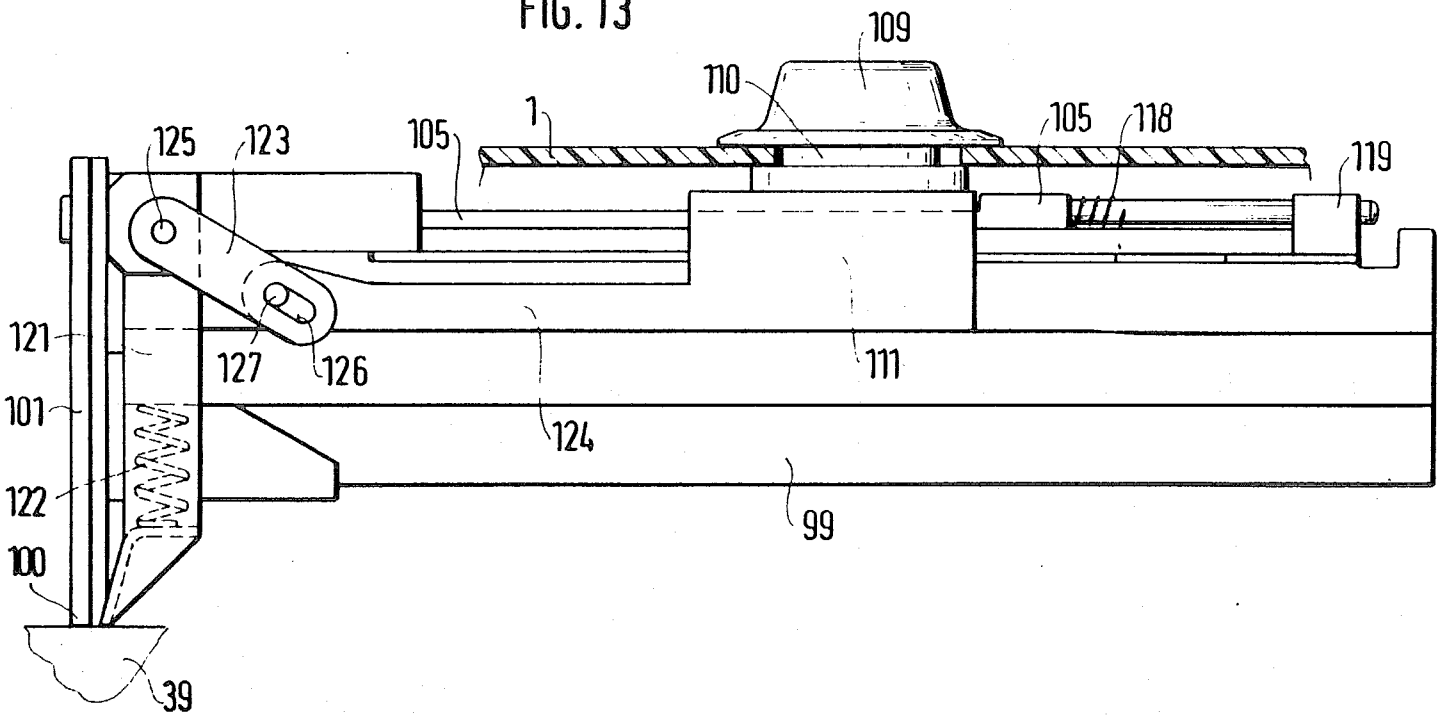
FIG. 13 is an expanded embodiment of the device shown in FIG. 11 on a side view.

The embodiment of FIGS. 11 and 12 is expanded in accordance with FIG. 13 to include a free shooting safety. Such a safety must be provided so that a fastener (staple or needle) can be supplied through the propelling passage only when the mouth of the propelling passage is arranged on a workpiece. For this purpose, as shown in FIG. 13 the possibility of subsequent striking of FIGS. 11 and 12 is used. The mouth piece 100 is here associated with a sensing slider 121 which is arranged under the action of the spring 122. The spring 122 always urges the sensing slider 121 to a position in which it projects over the end surface of the mouth piece 100. The sensing slider 121 is connected via a hinge piece 123 with displacing rod 124 on the bearing bracket 111. The hinge piece 123 is articulately connected with the sensing slider 121 by means of a pin 125. The other end of the hinge piece 123 extends inclined to the sensing slider 121 and is provided with an elongated opening 126. A second pin 127 engages in the elongated opening 126 and is mounted on the displacing rod 124.

When the stapler is placed on a workpiece 39, the sensing slider 121 is displaced back to the position shown in solid lines in FIG. 13. In this working position of the sensing slider 121, the stapler can be used in all adjustable modes, namely one-fastener operation, two-fastener operation, subsequent striking operation, which are adjusted by the handle 109. When the stapler is removed from the work piece 39, the sensing slider 121 is displaced by the force of the spring 122 to the position shown in broken line in FIG. 13. The force of the spring 122 overcomes the force of the springs 118 and 12. With this movement the slider 104 (FIGS. 11 and 12) is withdrawn so far that it is completely withdrawn from the working region of the driver 104 into the propelling passage 103. Thereby the desired free shooting safety is achieved. The elongated opening 106 is not required for the operation of this device as free shooting safety. It is available for allowing the operation of the stapler with a fast subsequent strikes. For this purpose the bearing bracket 111 can be simply withdrawn by the handle 109 without rotation of this handle. This withdrawal of the slider 105 from the region of the locking passage 103 and the driver 104 is possible because of the longitudinal opening 126. The function of the hinge piece 123 as a part of free shooting safety is thereby not affected.

Figure 14:
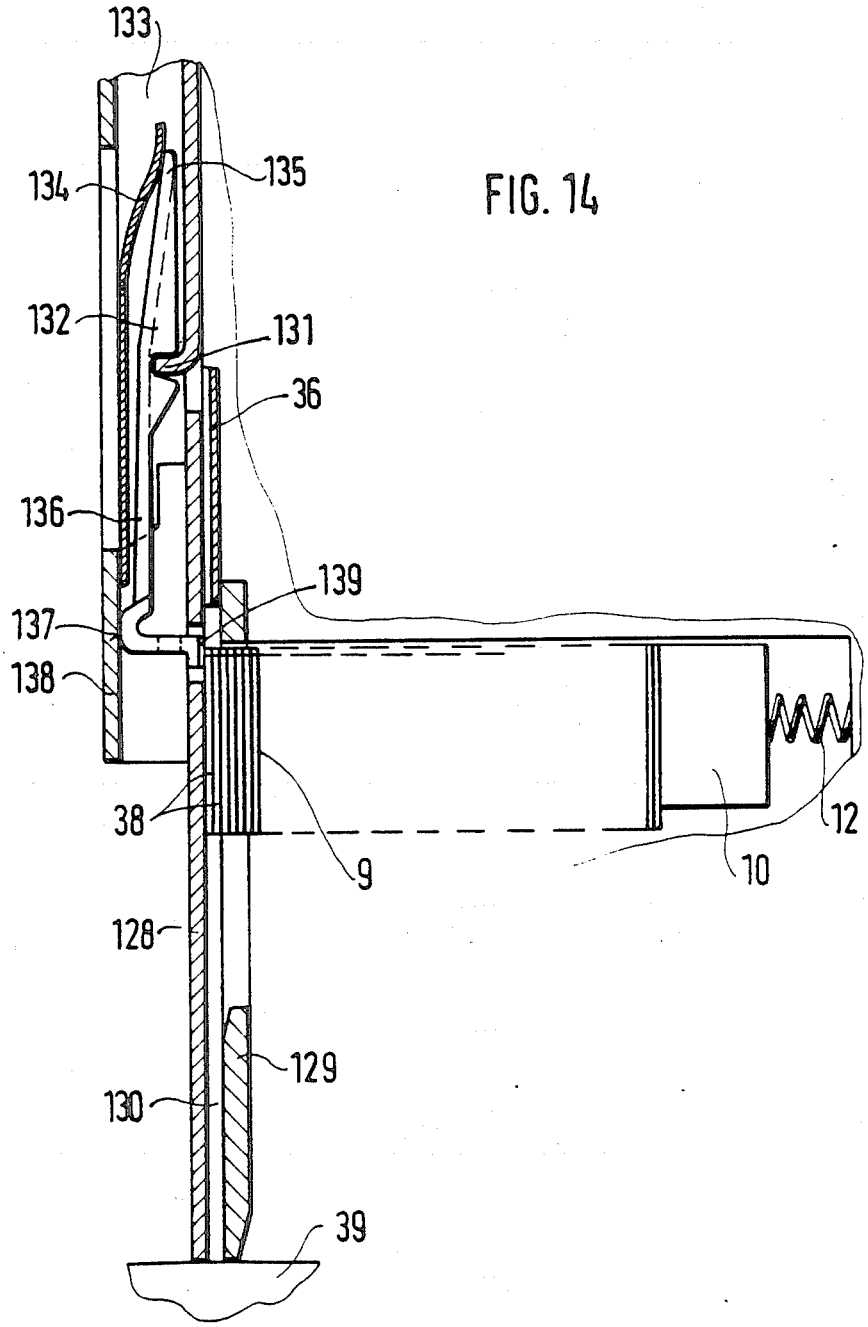
FIG. 14 is a view showing a seventh embodiment of the invention, in a simplified sectional view.

In the embodiment of FIG. 14 a front plate 128 is shown in combination with the rear plate 129, to form a propelling passage 130. In this propelling passage, a driver 36 can separate one or two fasteners 38 from the fastener set 9 and drive them into a work piece 39. A tongue 131 is secured to the front plate 128 and serves as a support for an angular lever 132. The angular lever 132 lies in the interior of the U-shaped slider 133, from which a springy tongue 134 is cut. The springy tongue 134 abuts in any position of the slider 133 against a lever arm 135 of the angular lever 132. It acts so that the other lever arm 136 of the angular lever 132 with its abutting surface 137 abuts against the inner surface of a magazine part 138. An edge 139 at the same end of the angular lever 132 serves as an abutment for the fastener set 9. Similarly to the embodiment of FIGS. 2 and 3, the shape of the abutment 139 and the driver 36 allows the selection between one-fastener operation and two-fastener operation. When the stapler in accordance with FIG. 14 must be switched from two-fastener operation to one-fastener operation, the slider 133 is displaced downwardly. Its rear part 140 displaces between the magazine 138 and the abutment surface 137 of the angular lever 132. Since the thickness of the rear part 140 corresponds to the thickness of one-fastener 38, one fastener 38 is displaced from the locking passage 130. Therefore, here also the desired object of switching between one-fastener operation and two-fastener operation is achieved.

It will be understood that each of the elements described above, or two or more together, may also find a useful application in other types of constructions differing from the types described above.

While the invention has been illustrated and described as embodied in a power driving device, particularly for fasteners, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A power impact device, particularly for fasteners, comprising means forming a propelling passage; a driver movable in said propelling passage; a magazine for fasteners and crossing said propelling passage; and an abutment arranged for positioning a set of fasteners for separating a frontmost fastener by said driver, said abutment being formed so that only a part of the cross-section of the set of fasteners is supported and so that it is displaceable relative to said propelling passage, said driver having a cross-section which deviates from a cross-section of said propelling passage over a fit tolerance so as to allow narrowing of said propelling passage without preventing movement of said driver and reducing its thickness.

2. A power impact device as defined in claim 1, wherein said driver has a U-shaped cross-section.

3. A power impact device as defined in claim 1, wherein said driver is provided with two tongues.

4. A power impact device as defined in claim 1, wherein said driver includes two driver parts, one of said driver parts being formed as a rigid driving sheet, the other of said driver parts being formed as a driver sheet which has two tongues springing toward one another and which faces toward said abutment.

5. A power impact device as defined in claim 1; and further comprising a spring which is arranged to urge the set of fasteners, said abutment being formed so that it is centrally supported on the set of fasteners against the action of said spring.

6. A power impact device as defined in claim 1; and further comprising a spring which is arranged to urge the set of fasteners, said abutment being formed so that it is supported on the set of fasteners at its edges against the action of said spring.

7. A power impact device as defined in claim 1, wherein said driver has a thickness which correspond to a thickness of two of the fasteners.

8. A power impact device as defined in claim 1, wherein the fasteners are movable in said propelling passage in a propelling direction, said abutment including a slider which is displaceable in the propelling direction and having at least one inclined surface.

9. A power impact device as defined in claim 1, wherein the fasteners are movable in said propelling passage in a propelling direction, said abutment being formed as a slider which is displaceable transverse to the propelling direction.

10. A power impact device as defined in claim 1, wherein the set of fasteners is movable in a displacement direction, said abutment including a body which is movable in and opposite to the displacement direction of the set of fasteners.

11. A power impact device as defined in claim 10; and further comprising adjusting means for said body and including a slider with an inclined surface.

12. A power impact device as defined in claim 1, wherein the set of fasteners is movable in a displacement direction, said abutment being formed as a body which is turnable opposite to said displacement direction of the set of fasteners.

13. A power impact device as defined in claim 12; and further comprising adjusting means for said turnable body and including a slider having a U-shaped cross-section.

14. A power impact device as defined in claim 1, wherein said abutment is provided with and movable by a handle.

15. A power impact device as defined in claim 14; and further comprising a catch with an inclined catching surface and connected with said handle so that during movement of said abutment from said propelling passage the set of fasteners is fixed outside of said propelling passage.

16. A power impact device as defined in claim 14, wherein said handle for said abutment is translatorily displaceable.

17. A power impact device as defined in claim 14, wherein said handle for said abutment is rotatable.

18. A power impact device as defined in claim 14; and further comprising arresting means for arresting said handle of said abutment.

19. A power impact device as defined in claim 1, wherein said abutment is provided with a sensing member which is arranged so that during placing the device on a workpiece and removing the device from the workpiece said sensing member is moved and its movement is transmitted to said abutment so that when the device is removed from the workpiece the set of fasteners is held outside of said propelling passage.

20. A power impact device as defined in claim 19; and further comprising means for connecting said sensing member with said abutment and including a coupling formed as a hinge piece.

* * * * *